US005752624A

United States Patent [19]

Vinson et al.

[11] Patent Number: 5,752,624

[45] Date of Patent: May 19, 1998

[54] ADJUSTABLE FOUNTAIN DISPENSER MERCHANDISING SYSTEM

[75] Inventors: W. David Vinson, Peachtree City; Angela D. Wessner, Marietta, both of Ga.; William C. Jackle, Oak Park; Jon A. Jepsen, Jr., Schaumberg, both of Ill.

[73] Assignee: The Coca-Cola Company, Atlanta, Ga.

[21] Appl. No.: 679,042

[22] Filed: Jul. 12, 1996

[51] Int. Cl.[6] ..... B67D 5/56

[52] U.S. Cl. ..... 222/78; 222/129.1; 222/183; 312/257.1; 312/265.6

[58] Field of Search ..... 222/78, 129.1, 222/183; 312/257.1, 265.1, 265.2, 265.3, 265.5, 265.6

[56] References Cited

U.S. PATENT DOCUMENTS

| | | | |
|---|---|---|---|
| 4,973,109 | 11/1990 | Diedrich | 312/265.6 X |
| 5,464,281 | 11/1995 | Maro | 312/257.1 |
| 5,607,211 | 3/1997 | Henninger et al. | 222/78 X |

FOREIGN PATENT DOCUMENTS

| | | | |
|---|---|---|---|
| 11830 | 2/1929 | Australia | 222/78 |

*Primary Examiner*—Joseph Kaufman

*Attorney, Agent, or Firm*—Thomas R. Boston

[57] ABSTRACT

An adjustable fountain dispenser merchandising system including: (1) a light-weight, adjustable framework for clamping onto a dispenser to support and anchor the merchandising system, and (2) merchandising panels removably attached to the framework.

10 Claims, 12 Drawing Sheets

ADJUSTABLE FOUNTAIN DISPENSER MERCHANDISING SYSTEM

BACKGROUND OF THE INVENTION

This invention relates to fountain beverage dispensers and in particular to a merchandising system for use therewith.

It is known to place decals and lighted signs on dispensers. It is also known to have separate, free-standing merchandising displays, which are large and take up valuable space, expensive, heavy, require skilled installation and can not be changed to a different look or message.

It is an object of this invention to provide an inexpensive, light-weight, merchandising system that is easy to install, easy to change the look or message, that takes up little space, and that is adjustable in size to fit on a wide range of dispensers.

SUMMARY OF THE INVENTION

An adjustable, fountain beverage merchandising system that is inexpensive and light-weight by virtue of using the mass of the dispenser itself to support and anchor the system, that is adjustable to fit a wide variety of sizes and shapes of dispensers, that uses easily replaced panels to change the look and message, that can be easily installed, and that easily pivots out of the way to provide service access to the dispenser.

The merchandising system of this invention includes an adjustable framework of telescoping legs and arms to clamp onto the dispenser without damage to the dispenser or to the countertop, and merchandising panels connected to the framework. In the preferred embodiment, the merchandiser includes a pair of curved plastic side panels that give the appearance of a beverage cup, a front graphics panel, ice panels and a straw. The plastic side panel and the front graphics panel are easily removed and replaced with different panels to change the look and/or message of the merchandising. The side panels are preferably translucent and lighted from behind. The front graphics panel is preferably front-lighted. The front framework section is preferably pivoted at one side to provide easy access to the dispenser.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
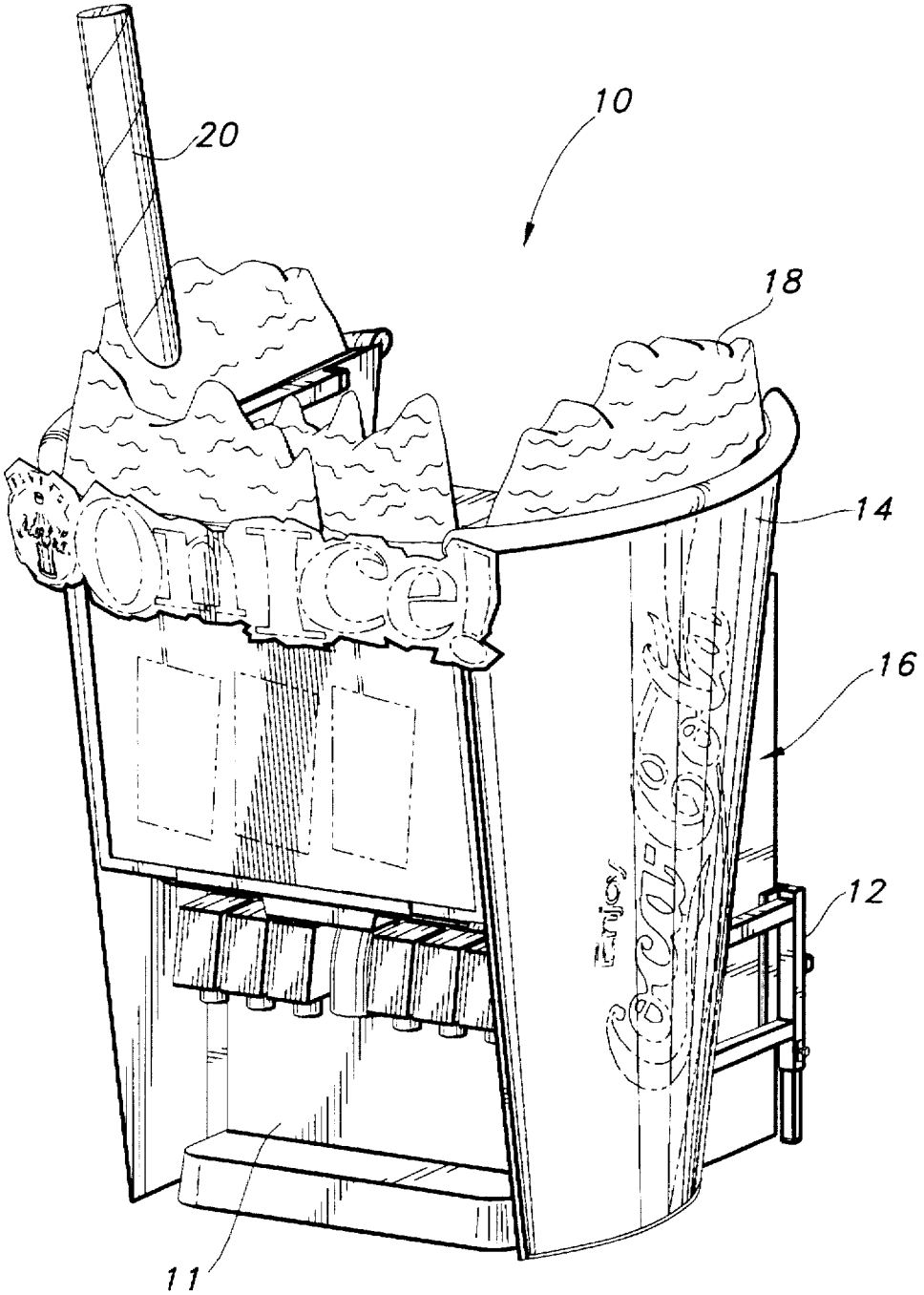
FIG. 1 is a front perspective view of the merchandising system of this invention shown installed on a dispenser.
Figure 2:
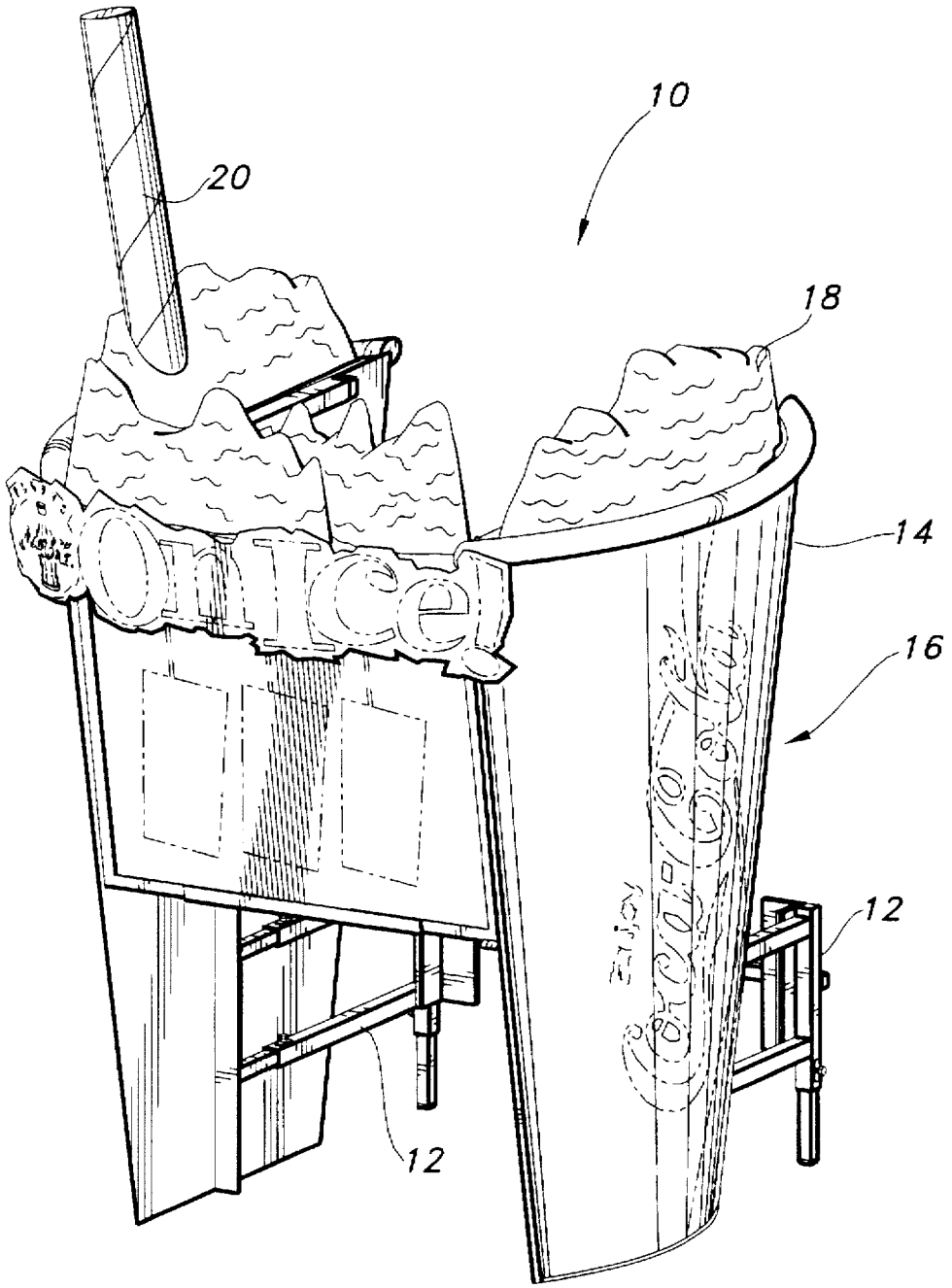
FIG. 2 is a view similar to FIG. 1 but without the dispenser.
Figure 3:
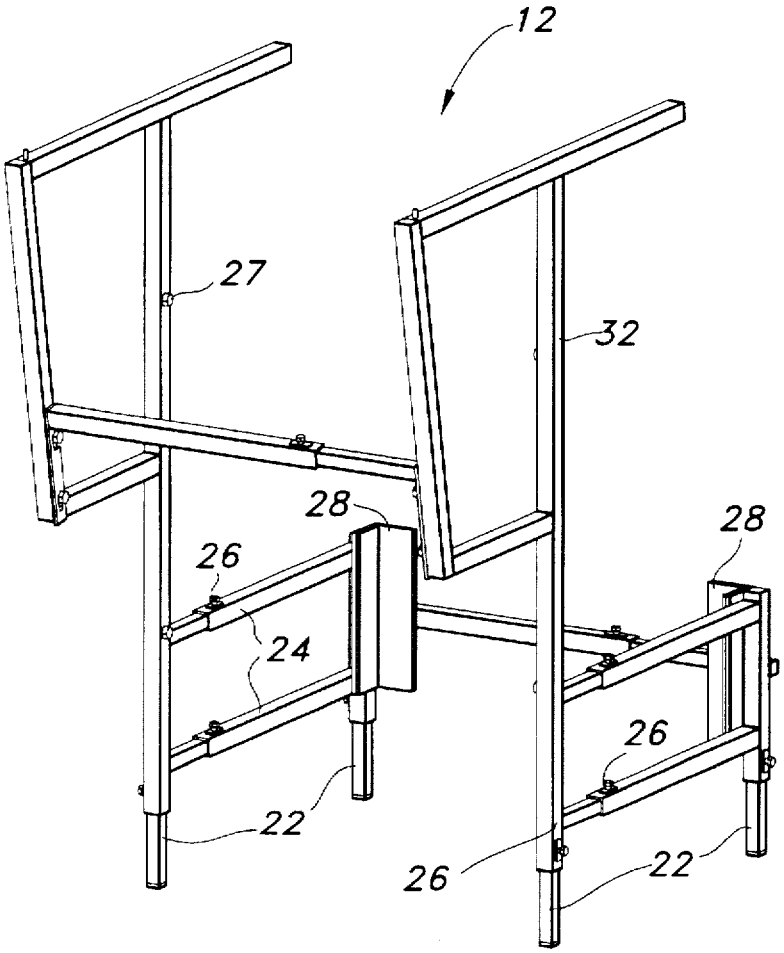
FIG. 3 is a perspective view of the framework but without the pivotable front section.
Figure 4:
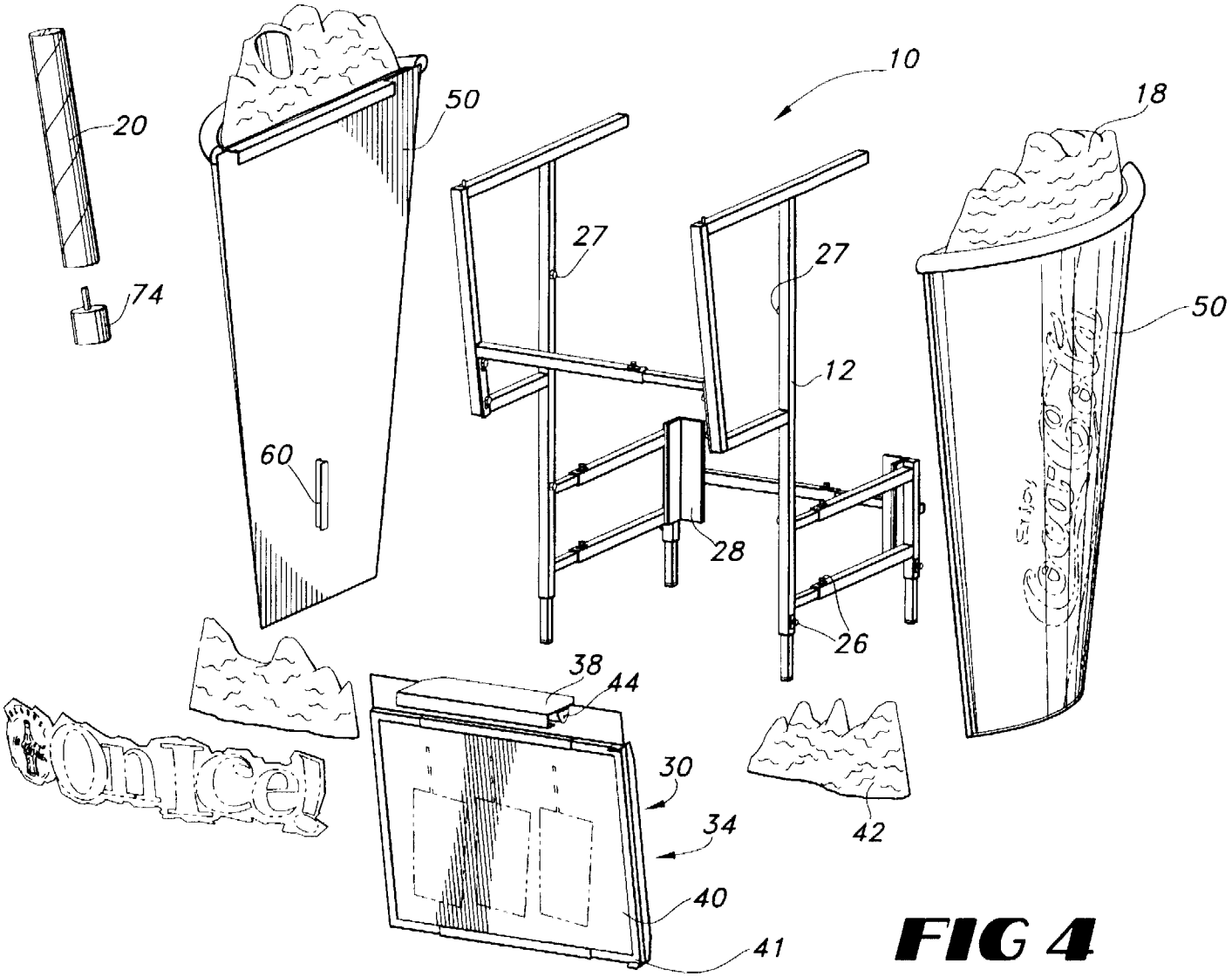
FIG. 4 is an exploded perspective view showing the framework and the merchandising panels.
Figure 5:
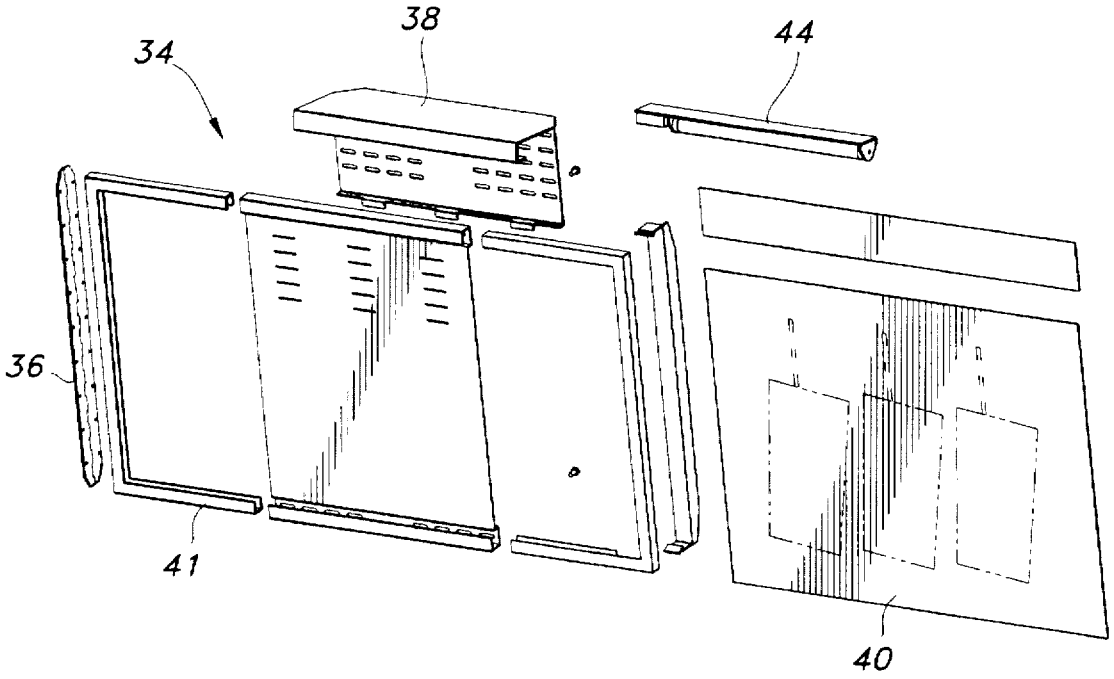
FIG. 5 is a perspective exploded view of the front framework section and graphics panel.

With reference now to the drawings, FIGS. 1–13 show the merchandiser 10 of the preferred embodiment of the present invention clamped on to a dispenser 11. The merchandiser 10 includes a framework 12 and a plurality of panels 14, which in this preferred embodiment give the appearance of a large cup 16 of beverage with ice 18 and a rotating straw 20.

The framework 12 includes a plurality of telescoping, tubular legs 22 and arms 24 which are adjustable in height and length, respectively. Each of the adjustable elements has a locking means, preferably a screw 26. L-shaped, foamed plastic pads 28 and bumpers 27 are provided on the portions of the framework that contact the dispenser to protect the dispenser. The framework clamps against the dispenser to support and anchor the framework. A front arm 29 can pivot down to provide access to the front of the dispenser 11.

Figure 6:
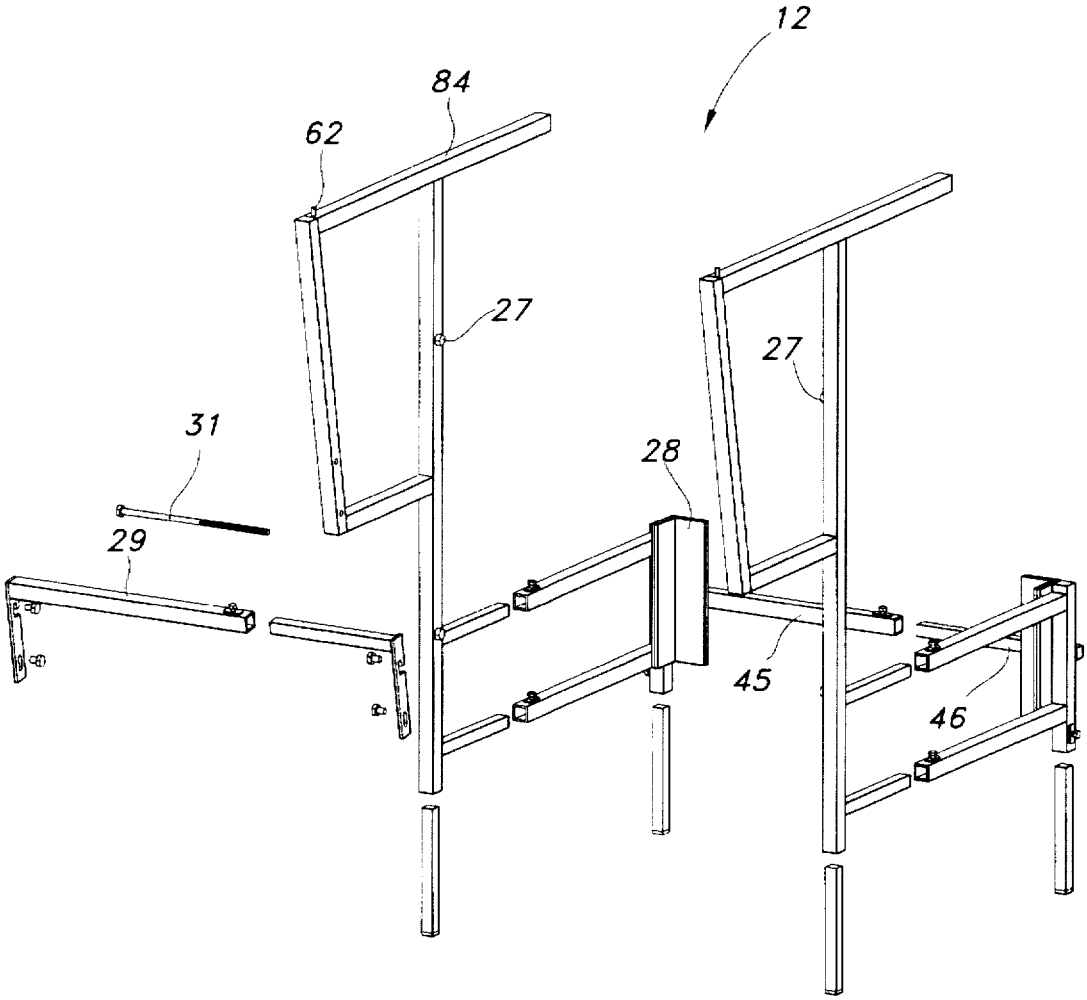
FIG. 6 is a perspective view of the framework showing the front brace exploded out.
Figure 6A:
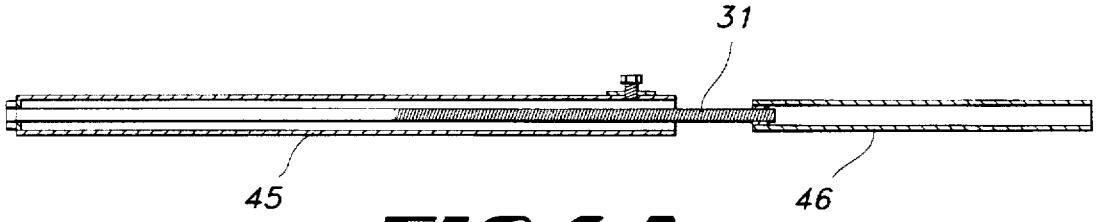
FIG. 6A is a cross-sectional view through the rear arm 45, 46 showing the threaded rod 31.
Figure 7:
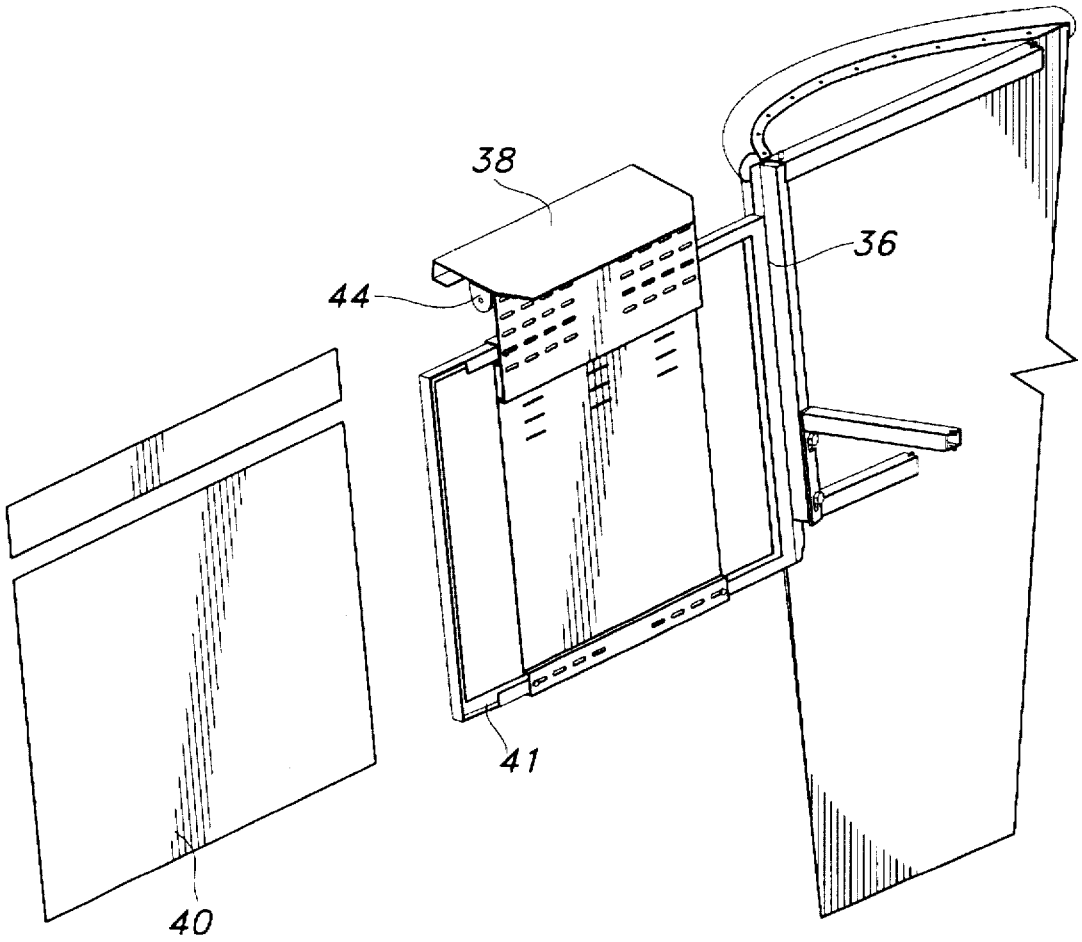
FIG. 7 is a partial perspective exploded view showing the front section pivoted to its open position.
Figure 8:
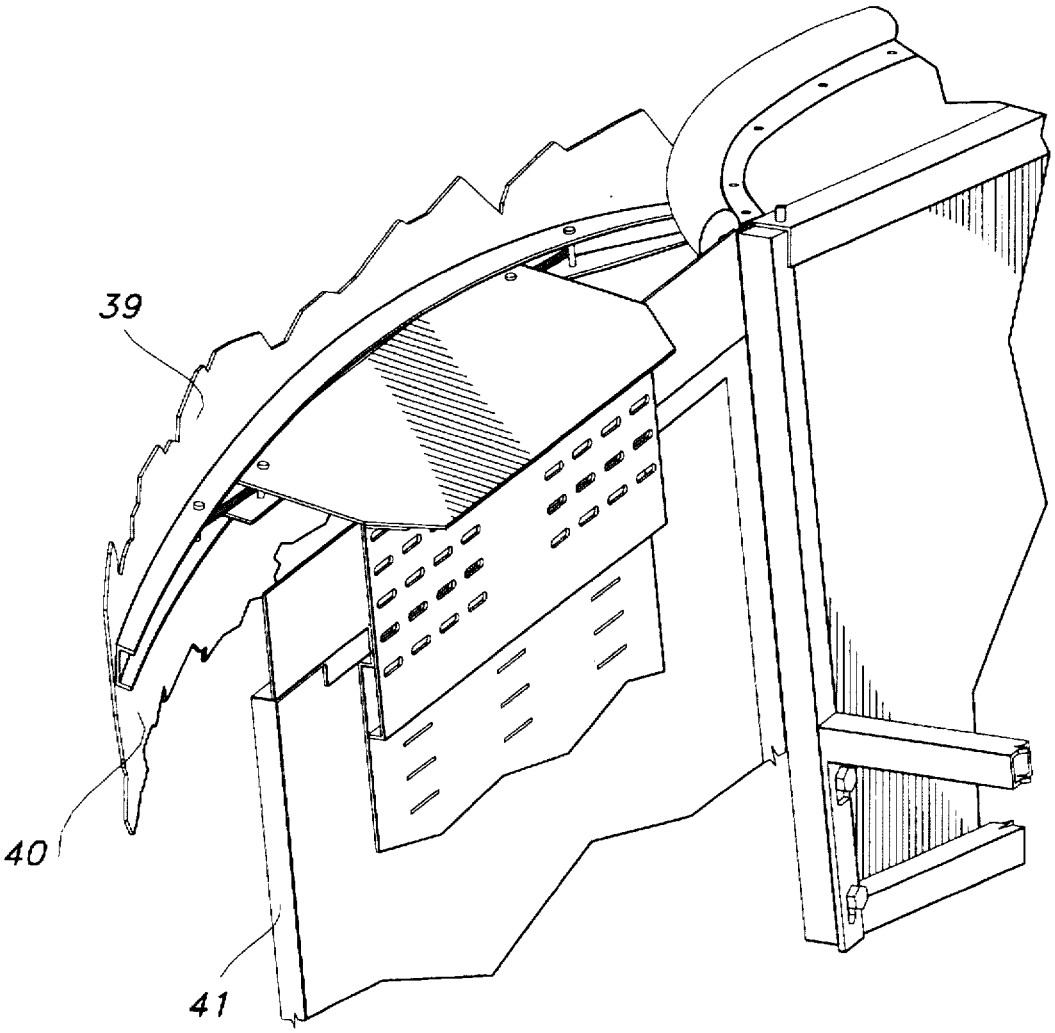
FIG. 8 is an enlarged perspective view of the header portion of the front section.
Figure 9:
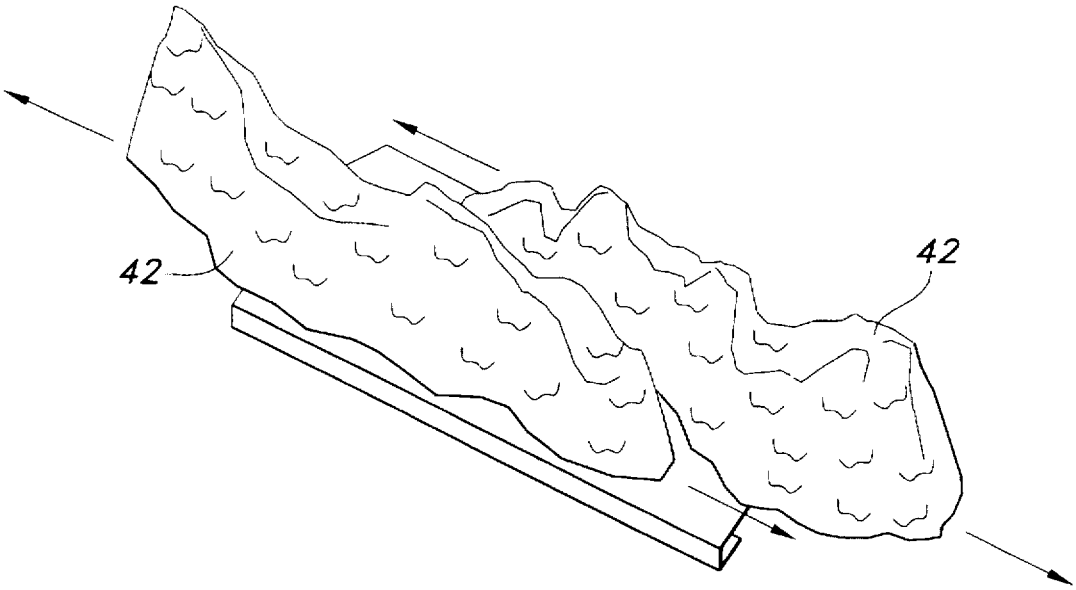
FIG. 9 is a top perspective view of the ice elements on the header portion.
Figure 10:
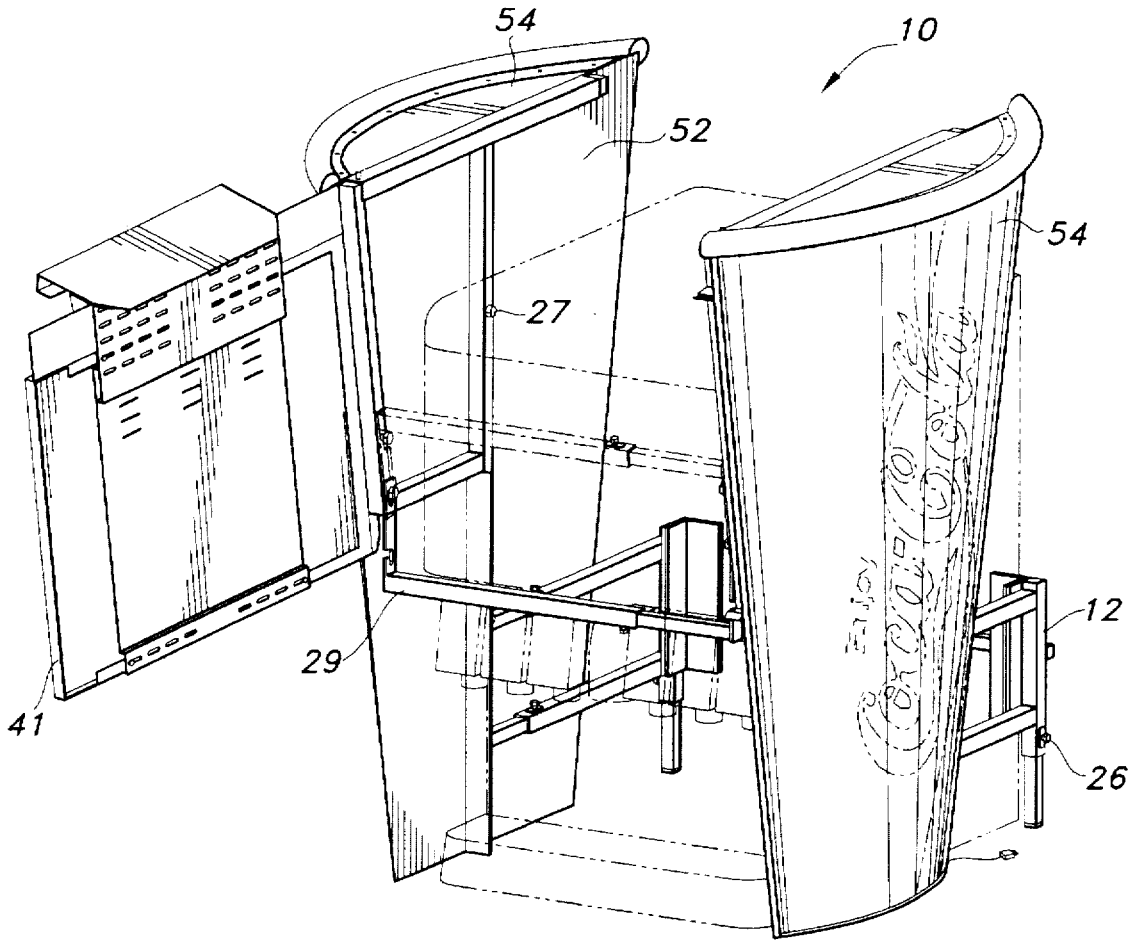
FIG. 10 is a perspective view of the merchandiser with the front section pivoted open and the front brace pivoted down.
Figure 11:
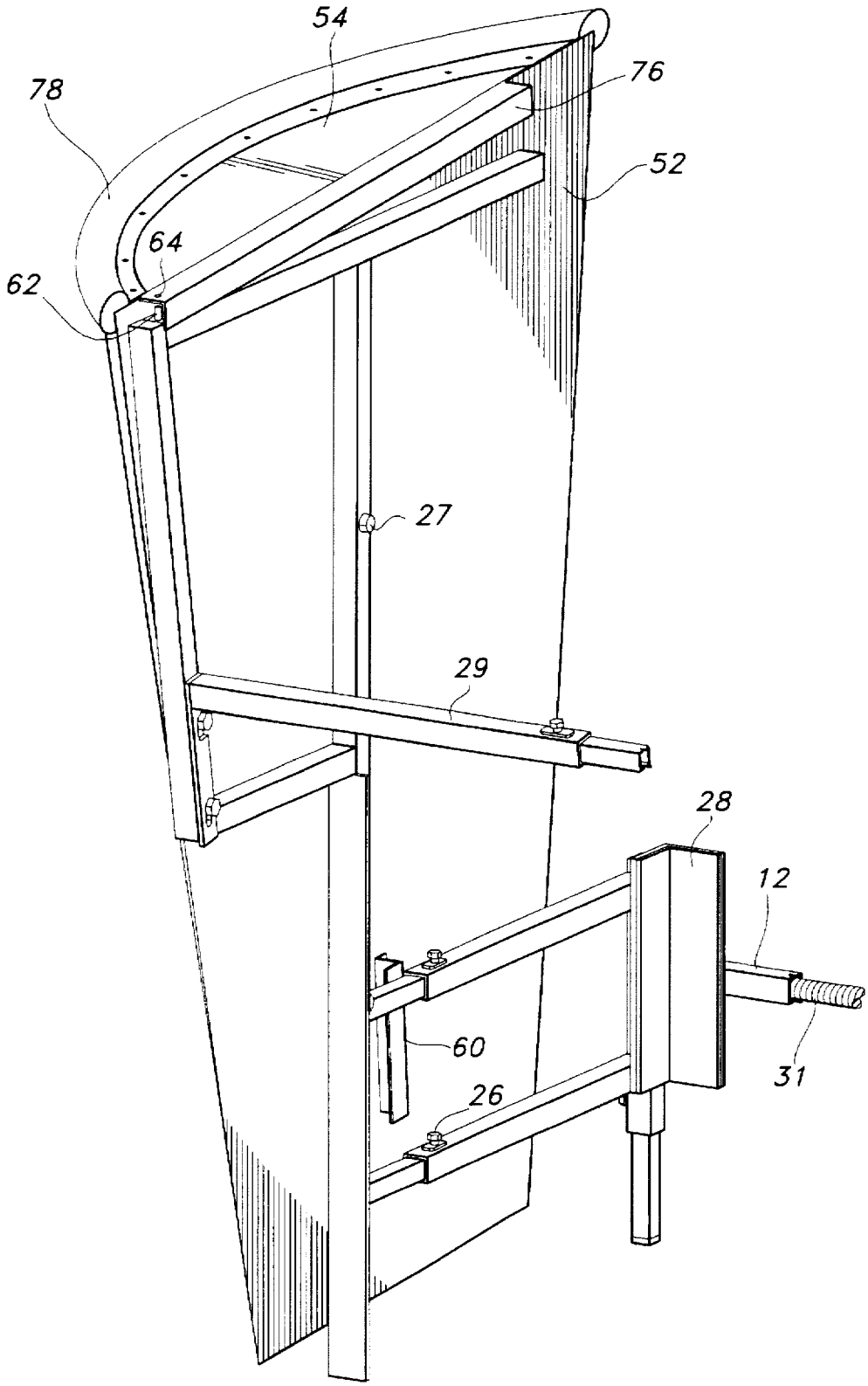
FIG. 11 is a perspective view of one side panel attached to the framework.
Figure 12:
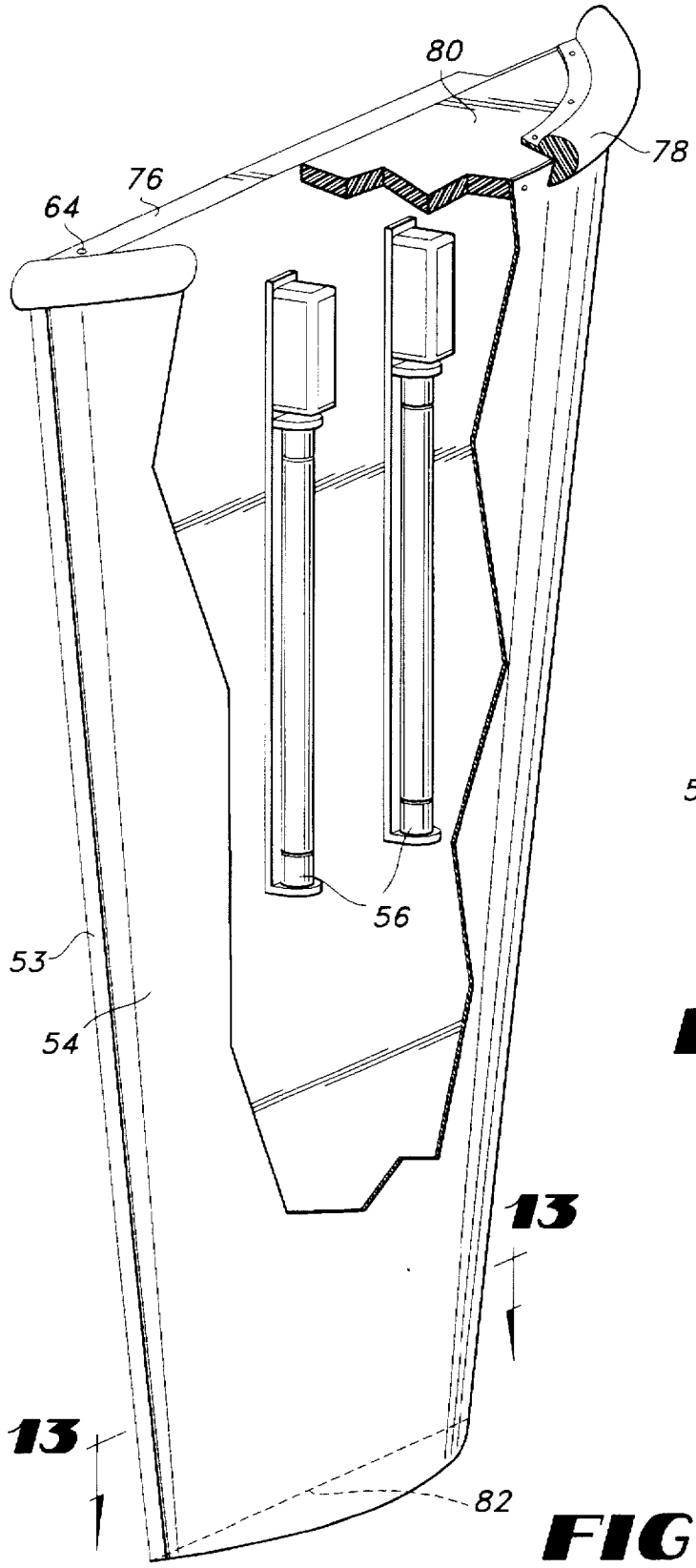
FIG. 12 is a partly broken-away perspective view of one side panel.
Figure 13:
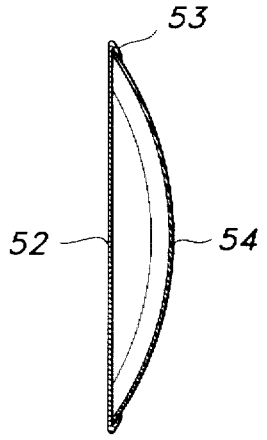
FIG. 13 is a cross-sectional view taken along line 13—13 of FIG. 12.

In the preferred embodiment, the rear arm (see FIG. 6 and FIG. 6A) includes an outer tube 45 and an inner tube 46. A threaded rod 31 extends through the tube 45 and the outer end has a head with a screw slot thereon. The inner end of the rod extends into an internally threaded wall on the end of the tube 46. This rod is tightened to clamp the framework against the dispenser.

A front framework section 30 is connected to the front legs 32 for slidably supporting therein a graphics section 34. The framework section 30 includes a frame 41 that is preferably hingedly connected at 36 to the left front leg so section 30 can pivot out to provide access to the dispenser. The section 30 also preferably has a header portion 38 connected on top of the frame 41 for holding ice panels 42 and a light source 44 to illuminate the graphics panel 40.

The panels 14 attached to the framework 12 include a pair of side panels 50 in addition to the front panel 40 described above. Each of the side panels includes an inside metal support panel 52 with angled end channels 53, a plastic, translucent, replaceable outside panel 54, and a light source 56. The outside panel is preferably clear plastic printed on the inside to provide the graphics, as is commonly clone on vending machines. The outside panel 54 is flat and is bent or curved when inserted into the channels 53 on the front and rear sides of the inner metal panel 52. A cap 80 is attached to the top of the metal panel and a base 82 is attached to the bottom of the metal panel and the outside panel is then attached, as by screws, to the base and cap. Then a lip 78 is screwed to the cap 80 to give the appearance of a cup lip.

The side panels 50 are attached to the framework 12 by means of a top channel member 76 of the inside metal panel having a hole 64 in which a pin 62 on the top of the framework fits. The side panel is tilted with its lower portion rearwardly, the pin is inserted into the hole, and then the lower portion of the panel is allowed to move forward until the bracket 60 on the lower inside surface of the metal panel engages a leg of the framework and the top channel member 76 seats on a top arm 84 of the framework. To clean the countertop around the dispenser, the side panels can be tilted out and/or back to provide access, because the hole 64 is larger than the pin 62. The outside panels 54 are easily changed by removing the screws into the cap and base and then sliding the plastic panel out of the metal inner panel.

On top of each of the side panels are preferably the ice panels 18. On top of one of the side panels is preferably a rotatable straw 72 connected to an electric motor 74.

All service to the dispenser can be performed with the merchandiser 10 attached thereto. The merchandiser 10 is easily installed with simple hand tools. Adequate air flow for mechanically refrigerated dispensers is allowed, and adequate room to fill an ice bin is provided. The front section 30 can be hinged at either the left or right side.

The panels can provide any desired look, such as of a glass, a sports drink barrel, etc.

While the preferred embodiment of this invention has been described above in detail, it is to be understood that variations and modifications can be made therein without departing from the spirit and scope of the present invention.

What is claimed is:

1. An adjustable fountain beverage dispenser merchandising system comprising:

(a) a light-weight, adjustable framework adapted to be clamped to the outside of a fountain dispenser, whereby the mass of a dispenser supports and anchors said framework;

(b) a plurality of merchandising panels attached to said framework;

(c) said framework including a plurality of vertical legs and horizontal arms, each of said legs and arms being adjustable in height and length, respectively, to clamp said framework onto a dispenser;

(d) said merchandising panels including a pair of side panels and a front panel removably connected to said framework.

2. The merchandising system as recited in claim 1 wherein said side panels are semi-cylindrical and give the appearance of a beverage cup.

3. The merchandising system as recited in claim 2 wherein said side panels include a flat inside, support panel and a plastic, removable outside panel.

4. The merchandising system as recited in claim 3 wherein said plastic outside panel is translucent and including a light source inside said side panels.

5. The merchandising system as recited in claim 1 wherein said framework includes a front frame section having means for removably supporting a front merchandising panel, and a front merchandising panel positioned in said front section.

6. The merchandising system as recited in claim 5 wherein said front frame section is hingedly connected to said framework whereby said front frame section can pivot out of the way to provide access to said dispenser.

7. The merchandising system as recited in claim 6 wherein said supporting means includes means for sliding said front merchandising panel out of said front frame section to replace it with a different panel.

8. The merchandising system as recited in claim 7 wherein said side panels are semi-cylindrical and give the appearance of a beverage cup.

9. The merchandising system as recited in claim 8 wherein said side panels include a flat inside, support panel and a plastic, removable outside panel.

10. The merchandising system as recited in claim 5 wherein said supporting means includes means for sliding said front merchandising panel out of said front frame section to replace it with a different panel.

* * * * *